US005855380A

United States Patent [19]

Di Filippo et al.

[11] Patent Number: 5,855,380

[45] Date of Patent: Jan. 5, 1999

[54] SUPPORTING FRAME FOR IN-LINE WHEELS OR FOR AN ICE-SKATING BLADE

[75] Inventors: Mario Di Filippo, Casella D'Asolo; Peter Edauw, Camalo' Di Povegliano, both of Italy

[73] Assignee: Toifin S.p.A., Brescia, Italy

[21] Appl. No.: 762,073

[22] Filed: Dec. 9, 1996

[30] Foreign Application Priority Data

Apr. 4, 1996 [IT] Italy ..... TV96A0047

[51] Int. Cl.[6] ..... A63C 17/18; A63C 9/18; A63C 1/16

[52] U.S. Cl. ..... 280/7.13; 280/613; 280/11.31; 280/11.22

[58] Field of Search ..... 280/7.13, 7.14, 280/11.22, 11.27, 11.31, 11.33, 613, 617, 618, 14.2, 11.28; 36/114, 115, 116

[56] References Cited

U.S. PATENT DOCUMENTS

| | | | |
|---|---|---|---|
| 5,705 | 12/1848 | Forbes | 137/867 |
| 40,745 | 12/1863 | Forbes | 280/11.31 |
| 47,682 | 5/1865 | Murray | 280/11.31 |
| 197,007 | 11/1877 | Becker, Jr. | 201/23 |
| 530,711 | 12/1894 | Nicholls | 280/11.31 |
| 656,819 | 8/1900 | Knapp | 280/11.31 |
| 1,094,434 | 4/1914 | Golden | 280/11.31 |
| 2,868,553 | 1/1959 | Rieckman | 280/7.13 |
| 3,888,499 | 6/1975 | Gertsch et al. | 280/613 |
| 3,893,682 | 7/1975 | Weinstein et al. | 280/613 |
| 3,910,591 | 10/1975 | Salomon | 280/613 |
| 3,963,251 | 6/1976 | Miano | 280/7.13 |
| 4,008,901 | 2/1977 | Conn | 280/7.13 |
| 4,021,056 | 5/1977 | Oakes | 280/613 |
| 4,114,295 | 9/1978 | Schaefer | 36/100 |
| 4,144,659 | 3/1979 | Eisenberg | 36/120 |
| 4,188,046 | 2/1980 | Fleckenstein | 280/618 |
| 4,298,209 | 11/1981 | Peters | 280/11.2 |
| 4,328,627 | 5/1982 | Sanders | 36/115 |
| 4,353,574 | 10/1982 | Faulin | 280/613 |
| 4,353,575 | 10/1982 | Brice | 280/614 |
| 4,870,761 | 10/1989 | Tracy | 36/51 |
| 5,257,793 | 11/1993 | Fortin | 280/7.13 |
| 5,320,366 | 6/1994 | Shing | 280/7.14 |
| 5,357,695 | 10/1994 | Lu | 36/115 |
| 5,524,912 | 6/1996 | Laub et al. | 280/7.13 |
| 5,595,392 | 1/1997 | Casillas | 280/7.13 |
| 5,704,139 | 1/1998 | Okajima | 36/115 |

*Primary Examiner*—Brian L. Johnson
*Assistant Examiner*—Bridget Avery
*Attorney, Agent, or Firm*—Rockey, Milnamow & Katz, Ltd.

[57] ABSTRACT

A supporting frame for in-line wheels or for an ice-skating blade, including elements for the temporary engagement, centering, and locking of coupling elements which are rigidly coupled below and to the rear of a soft shoe that is adapted for walking. It is thus possible to use, for skating, a shoe used for normal walking.

22 Claims, 2 Drawing Sheets

SUPPORTING FRAME FOR IN-LINE WHEELS OR FOR AN ICE-SKATING BLADE

BACKGROUND OF THE INVENTION

The present invention relates to a supporting frame for in-line wheels or for an ice-skating blade.

Conventional roller skates nowadays usually have a frame for supporting the wheels or an ice-skating blade which is substantially U-shaped in transverse cross-section; a shoe, constituted by a rigid plastic shell to which a likewise rigid cuff for containing an optional soft innerboot is usually articulated, is associated in an upward region, by means of rivets or screws, at the flat base of the frame.

These conventional solutions contrast with one of the user's requirements, which is to use roller skates as a means of transport: currently, such conventional solutions force the user to separately carry soft shoes for easy walking as replacement once he has stopped skating.

As a partial solution to this drawback, skates are known which comprise a frame with which a toe unit and a heel unit provided with fastening means are associated; a shoe, even of the type used for ordinary walking, is inserted at said toe and heel units.

However, this solution has considerable drawbacks, since the shoe is not perfectly associated with the frame and therefore relative movements of the foot and of the leg with respect to said frame are possible, to the detriment of the smoothness of the skating action.

Furthermore, during thrusting the shoe can slip out of the toe unit, with consequent severe drawbacks for the user.

Finally, it is noted that the movement of the leg during skating is not ideal, since the leg must be firmly locked to the fastening means.

SUMMARY OF THE INVENTION

A principal aim of the present invention is therefore to solve the described problems, eliminating the drawbacks of the mentioned prior art and thus providing a frame for roller skates or ice skates that can use shoes which are also adapted for ordinary walking.

Within the scope of this aim, an important object is to provide a frame with which it is possible to associate soft shoes while allowing to skate easily and in an optimum manner.

Another object is to provide a frame that allows quick, safe, and easy coupling of soft shoes and an equally quick uncoupling thereof.

Another object is to provide a frame that is structurally simple and can be manufactured with conventional machines and equipment.

This aim, these objects, and others which will become apparent hereinafter are achieved by a supporting frame for in-line wheels or for an ice-skating blade, comprising means for the temporary engagement, centering, and locking of coupling means which are rigidly coupled below and to the rear of a soft shoe that is adapted for walking.

BRIEF DESCRIPTION OF THE DRAWINGS

Further characteristics and advantages of the invention will become apparent from the following detailed description of a particular but not exclusive embodiment thereof, illustrated only by way of non-limitative example in the accompanying drawings, wherein.

DESCRIPTION OF THE PREFERRED EMBODIMENTS

Figure 1:
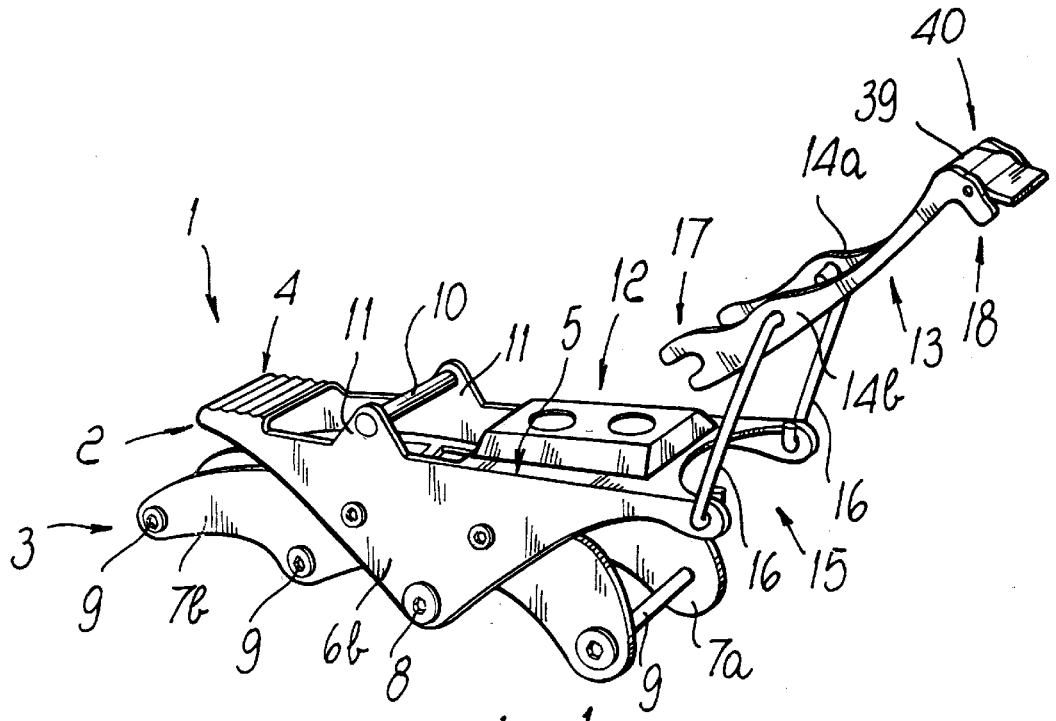
FIG. 1 is a perspective view of the supporting frame.
Figure 2:
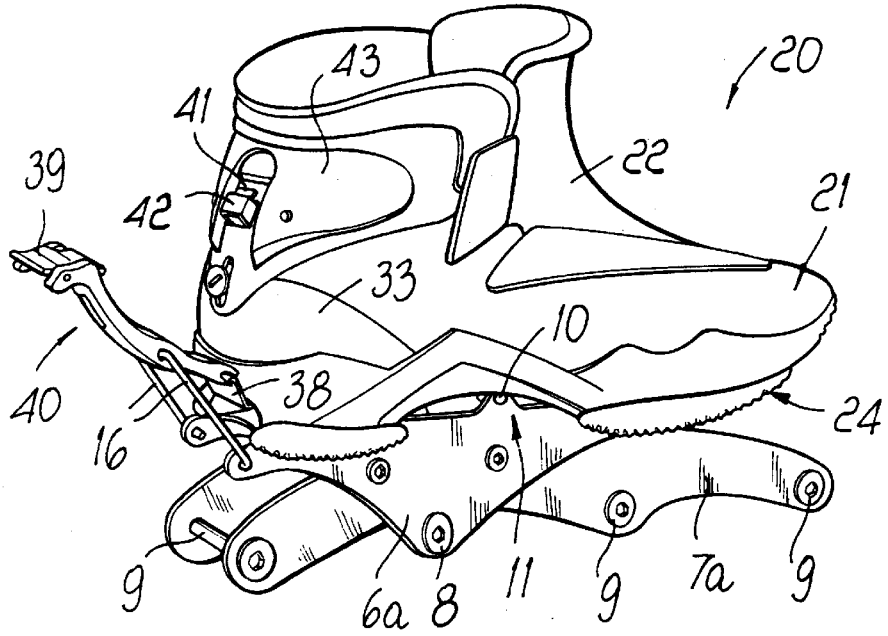
FIG. 2 is a perspective view, similar to FIG. 1, of the frame with a shoe associated therewith.
Figure 3:
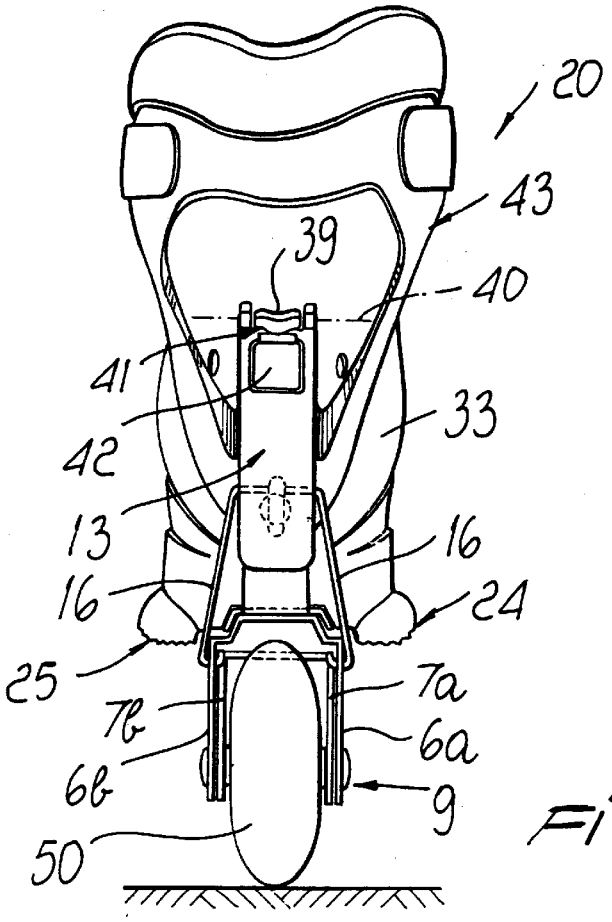
FIG. 3 is a rear view of the frame with the shoe associated therewith.
Figure 4:
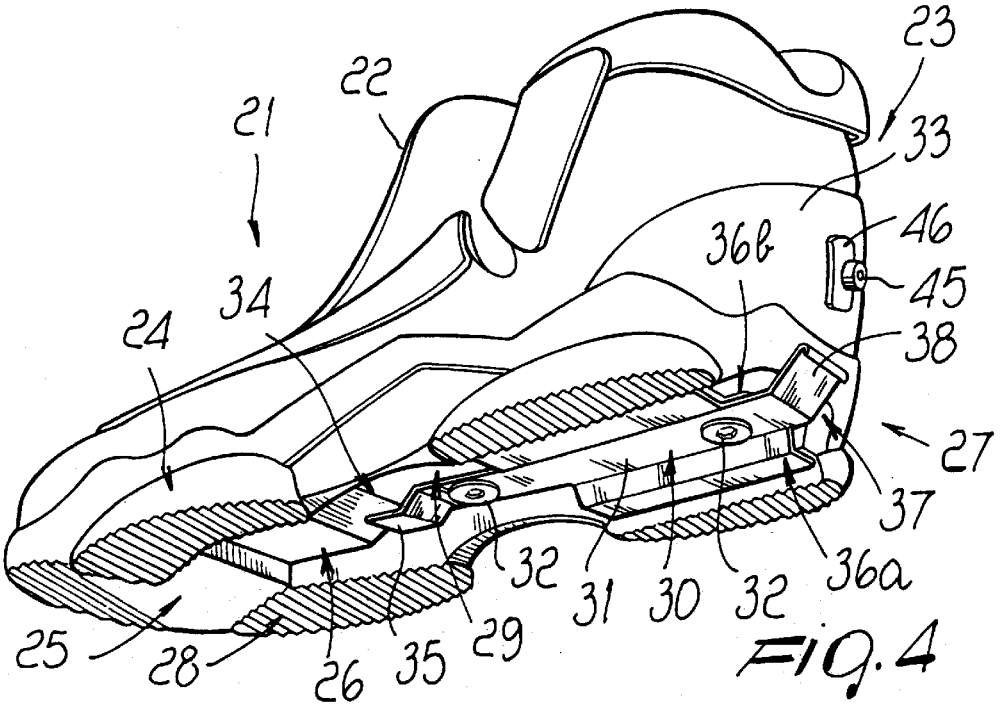
FIG. 4 is a perspective view of the shoe, taken from below.

With reference to the above figures, the reference numeral 1 generally designates the supporting frame, which is constituted by a first element 2 and by a second element 3 associated to each other by adapted screws.

First element 2 is C-shaped and defines a front base 4, a flat rear base 5, and two first lateral wings 6*a* and 6*b* that protrude towards the ground.

Second element 3 is interposed between the two first wings 6*a* and 6*b* and comprises two second wings 7*a* and 7*b* that protrude towards the ground.

Wheels 50 are pivoted between the first wings and the second wings by means of an adapted first pivot 8 and second pivots 9, and are thus arranged in-line; as an alternative, the wheels can be arranged side by side in pairs.

As an alternative, an ice-skating blade (not shown in the drawings) is associated between the first and second wings.

Frame 1 has first engagement means for a shoe 20 which are constituted by at least one third pivot 10 or by a bar or by a bridge that is arranged transversely to two shoulders 11 that protrude above the front base 4 and the rear base 5 at the plane of arrangement of the first wings 6*a* and 6*b*.

The first means protrude approximately at the pre-arch or toe region.

Frame 1 furthermore has centering means constituted by at least one raised portion 12 which protrudes upwards and along the axis that runs longitudinally to the flat rear base 5; raised portion 12 is arranged on a plane which is lower than a plane that is parallel thereto and passes through the third pivot 10.

Frame 1 also has first locking means for the shoe which are constituted by a lever arm 13 that is substantially U-shaped in cross-section, so as to form third wings 14*a* and 14*b* which are centrally or eccentrically pivoted to the underlying tip 15 of the first element 2 by means of adapted arms 16.

A first end 17 of the third wings 14*a* and 14*b* is preferably fork-shaped.

A safety hook 39 is pivoted transversely, and optionally in contrast with a flexible element, at the second end 18 of the third wings 14*a* and 14*b* of the lever arm 13, which is opposite to the fork-shaped end.

A soft shoe 20 is detachably associable with the supporting frame 1 for in-line wheels or for an ice-skating blade and is composed of an upper 21, made of soft material, which has, at the foot instep region, an opening which forms two flaps, which mutually overlap at an adapted tongue 22 associated with said upper.

The upper also has a heel cup 23, which is also made of soft material and wraps around the malleolar region of the foot, whilst an adapted sole 24 is associated or rigidly coupled below the upper 21.

At least one seat 26 is formed at the lower surface 25 of the sole 24 and longitudinally thereto and affects the sole, starting from the rear end 27 thereof, approximately up to the region 28 that is adjacent to the pre-arch of the foot but to the rear of the region of the foot sole that must flex during walking.

This region differentiates the shoe 20 into a part that is essential for walking (the one directed towards the tip of the upper) and a part that is essential for skating (the one directed towards the heel).

Seat 26 is substantially omega-shaped or trapezoidal in a transverse cross-section, so as to form at least one substantially flat resting surface for a rigid plate 30, which is connected to two inclined side walls.

Plate 30 also has a body 31 whereon adapted holes are provided which act as seats for adapted first screws 32 for coupling to an adapted rigid or semirigid insole, which is interposed between the upper 21 and the sole 24 and from which an adapted rigid counter 33 protrudes to the rear.

Surface 29 of the seat 26 and the dimensions of the plate 30 are such as to arrange the body 31 on a plane that is approximately parallel to the underlying plane on which the remaining part of the sole 24 rests on the ground.

Plate 30 has, at the end that is arranged approximately in the pre-arch region of the foot, first engagement means which cooperate with the grip means provided on the frame 1 and are constituted by a first L-shaped wing 34, having a first tab 35 which is arranged on a plane which is approximately parallel to the plane of the surface 29 towards the ground.

The first engagement means constituted by the first wing 34 temporarily interact with the third pivot 10: substantially, the shoe 20 is associated with the frame 1 by inserting the first tab 35 below the third pivot 10.

The L-shaped configuration of the first engagement means allows to contrast any impacts to which the frame might be accidentally subjected during skating, so as to allow to keep the shoe 20 in its position and coupled to the frame.

Shoe 20 furthermore interacts with the centering means provided on the frame and constituted by at least one raised portion 12: plate 24 in fact has two second wings 36*a* and 36*b*, which protrude laterally with respect to the body 31 and are shaped approximately complementarily to the raised portion and to seat 26.

Plate 30 also has, at the end that is adjacent to the rear end 27 of the sole 24, second engagement means, which cooperate with the locking means provided on the frame; the second engagement means are constituted by a third L-shaped wing 37, having a second tab 38 which protrudes to the rear of the sole 24 and is inclined upwards.

The free end of the third wing 38 interacts with the first fork-shaped end 17 of the third wings 14*a* and 14*b* of the lever arm 13: in this way, the position of the shoe at the underlying frame 1 is locked.

Frame 1 also has second means for locking to the shoe 20, which are constituted by a safety hook 39 which is pivoted, optionally in contrast with a flexible element, to the third end 40 of the third wings 14*a* and 14*b* of the lever arm 13, which lies opposite to the fork-shaped end.

Hook 39 temporarily interacts with a tooth 41 which protrudes upwards with respect to a box-like body 42 which is in turn associated with, and protrudes to the rear of, a rigid cuff 43 that is oscillatably pivoted to the counter 33.

Cuff 43 in fact has, to the rear and below box-like body 42, a longitudinal slot 44 in which it is possible to slidingly position an adapted pin 45, which protrudes from a plate 46 that is associated in a rearward position at the counter 33.

Cuff 43 and counter 33 are interconnected by using an adapted second screw 47; cuff 43 is thus allowed to oscillate along a plane which is substantially transverse or longitudinal with respect to the sole 5 or along a combination of two planes and said oscillation can be blocked by coupling the hook 39 and the tooth 41 one another; the shoe is thus rigidly coupled to the frame 1 and is therefore in the condition for skating.

The closure of the lever arm 13 also allows to limit the rearward longitudinal flexing of the cuff whilst maintaining effectiveness in braking, as well as forward longitudinal flexing by entrusting it to the deformation of the materials and to the lateral flexing of the shoe, so as to make it mote adapted for skating.

If instead the user wishes to walk normally, it is sufficient to disengage the hook 39 from the tooth 41, open the lever arm 13, and extract the shoe 20 from the third pivot 10 of the frame 1.

It has thus been observed that the invention has achieved the intended aim and objects, a frame for roller skates or ice skates having been provided which can use shoes that are also used for normal walking, the shoes being associable with the frame quickly, easily, and safely, whilst allowing to skate easily and in an optimum manner and to perform equally easy disengagement once skating has ended.

Finally, the arrangement of the plate at the seat formed on a plane that is raised with respect to the surface of the sole that interacts with the ground during walking allows to achieve optimum effectiveness in the connection to the frame, regardless of the wear factor of the sole.

The omega-shaped or trapezoidal shape of the plate and of the seat allow to achieve optimum transmission of the forces applied during lateral thrusting while skating.

The invention is of course susceptible of numerous modifications and variations, all of which are within the scope of the same inventive concept.

Thus, for example, as an alternative to the use of the rigid plate, it is possible to provide, below the insole, a tab that is applied or monolithic with respect to the insole and is omega-shaped or trapezoidal; the tab is arranged at the seat, making it pass through an adapted opening provided in the sole.

Advantageously, the tab and optionally the entire insole are made of rigid plastics, for example of a material known by the trade-name Nylon, which has a variable thickness and particularly becomes thinner in the pre-arch region of the foot to allow the flexing required for walking.

The materials and the dimensions constituting the individual components of the invention may of course also be the most appropriate according to the specific requirements.

What is claimed is:

1. A supporting frame for in-line wheels or for an ice-skating blade, comprising coupling means for being rigidly coupled below and to the rear of a soft shoe that is adapted for walking, and means for the temporary engagement, centering and locking of said coupling means, means for engagement for said shoe being provided which comprise at least one transverse pivot arranged transversely with respect to a pair of shoulders that protrude upwardly with respect to a front base and a flat rear base of said frame, said centering means comprising at least one raised portion which protrudes upwardly and along an axis that runs longitudinally with respect to said flat rear base, said at least one raised portion being arranged on a lower plane with respect to a plane that is parallel thereto and passing through said at least one transverse pivot.

2. A frame according to claim 1, comprising a first element and a second element which are associated to each other by screws, with which wheels or an ice-skating blade are associated by means of first and second pivots.

3. A frame according to claim 1, wherein said means for engagement protrude approximately at the region lying below the pre-arch portion of the tip of the foot.

4. A frame according to claim 1, wherein said soft shoe associable thereto is composed of an upper, made of soft material, which has a heel cup that wraps around the malleolar region of the foot and is provided, in a downward region, with a sole, and wherein at least one seat for at least one rigid plate is provided at a lower surface of said sole and longitudinally thereto.

5. A frame according to claim 4, wherein said at least one seat affects said sole starting from a rear end thereof up to the region that is adjacent or in front of the pre-arch region or the tip of the foot.

6. A frame according to claim 4, wherein said engagement means temporarily cooperate with first fastening means which are associated with said shoe and are constituted by a first wing, which protrudes from the end of said plate that is directed towards a tip, said first L-shaped wing having a first tab which is arranged on a plane that is approximately parallel to the plane of said seat.

7. A frame according to claim 4, wherein said means for locking temporarily cooperate with second engagement means, which are provided on said at least one rigid plate and are constituted by a side L-shaped wing, a second tab whereof protrudes to a rear of said sole and is inclined upwards.

8. A frame according to claim 5, wherein said seat is omega-shaped or trapezoidal in a transverse cross-section, so as to form at least one flat resting surface for said at least one rigid plate, which has a pair of second inclined lateral wings which can be arranged on said at least one raised portion.

9. A frame according to claim 8, wherein said at least one rigid plate is associable with a rigid or semirigid insole, which is interposed between said upper and said sole and from which a rigid counter protrudes rearwardly.

10. A frame according to claim 8, wherein said means for centering temporarily cooperate with said at least one pair of second inclined lateral wings, which are provided on said at least one rigid plate and are shaped complementarily to said at least one raised portion.

11. A frame according to claim 9, further comprising second locking means to lock said frame to said shoe, said locking means being constituted by a safety hook that is pivoted, in contrast with a flexible element, to the end of said side wings of said lever arm that is opposite to the fork-shaped elements, said hook temporarily interacting with a tooth that protrudes above a rigid box-like body that is in turn associated with, and protrudes to the rear of, a rigid cuff which is oscillatably pivoted, to said counter of said shoe.

12. A frame according to claim 9, wherein at least one omega-shaped or trapezoidal tab protrudes below said insole, is applied to said insole or monolithic therewith, is arranged at said seat, and passes through an opening formed on said sole.

13. A frame according to claim 6, wherein said first fastening means are temporarily associable with said transverse pivot.

14. A frame according to claim 7, wherein a free end of said side wing interacts with fork-shaped elements of said third wings of said lever arm to lock said shoe at said frame.

15. A frame according to claim 11, wherein said cuff has, to the rear and below said box-like body, a longitudinal slot in which a pin is slidingly arrangeable, said pin protruding from a plate associated in a rearward position at said counter, the connection between said cuff and said counter being achieved by means of a second screw, said cuff being free to oscillate along a plane that is transverse or longitudinal with respect to said sole or along a combination of said two planes, said oscillation being lockable by coupling said hook and said tooth one another.

16. A frame according to claim 12, wherein said at least one tab is made of rigid plastics of variable thickness, said thickness decreasing in the pre-arch region of the foot to allow the flexing necessary for walking.

17. A supporting frame for in-line wheels or for an ice-skating blade, comprising coupling means for being rigidly coupled below and to the rear of a soft shoe that is adapted for walking, and means for the temporary engagement, centering and locking of said coupling means, said means for locking said shoe comprise a lever arm pivoted at a rear end of said frame, said lever arm being U-shaped in cross-section so as to form side wings, which are centrally or eccentrically pivoted at an underlying rear tip of said frame, said side wings of said lever arm having, at a first end, fork-shaped elements.

18. A supporting frame for in-line wheels or for an ice-skating blade, comprising coupling means for being rigidly coupled below and to the rear of a soft shoe that is adapted for walking, and means for the temporary engagement, centering and locking of said coupling means, said means for locking said shoe comprise a lever arm pivoted at a rear end of said frame, said lever arm being U-shaped in cross-section so as to form side wings, which are centrally or eccentrically pivoted at an underlying rear tip of said frame, a safety hook being transversely pivoted to said side wings, at a second end and in contrast with a flexible element.

19. A supporting frame for supporting in-line skate wheels or an ice-skating blade and removably attachable to a sole of a sports shoe adapted for walking, the supporting frame comprising:

a rigid plate element (30) attachable to a bottom of a sole (24) of a sports shoe (20) such that said rigid plate element is accommodated inside a seat (26) in the bottom of the sole and such that said rigid plate does not protrude below a walking surface of the sole for facilitating walking with the sports shoe in a walking mode, said rigid plate element comprising a first engagement element (35) which is accommodated inside the seat in the bottom of the sole when the rigid plate element is attached to the bottom of the sole such that said first engagement element presents an engagement surface facing towards a front end of the sports shoe;

a frame element (2,3) for supporting in-line skate wheels or an ice-skating blade and being removably attachable with said rigid plate element, said frame element comprising a second engagement element (10) which engages with said engagement surface of said first engagement element when said frame element is attached with said rigid plate element attached to the bottom of the sole such that said second engagement element is arranged between said engagement surface and the front end of said sports shoe; and a lever element (13) pivotally attached to said frame element and operable for releasably connecting said frame element to a rear portion (41) of the sports shoe above the sole such that said second engagement element releasably locks into engagement with said engagement surface of said first engagement element for rigidly releasably attaching the supporting frame to the sole of the sports shoe.

20. The supporting frame of claim 19 wherein said engagement surface of said first engagement element is arranged approximately at an arch region of the shoe when said rigid plate element is attached to the bottom of the sole.

21. The supporting frame of claim 19 further comprising a raised portion (12) which protrudes from said frame element and which has a substantially trapezoidal-shaped transverse cross section for engaging inside a complementarily shaped portion of the seat of the sole of the sports shoe.

22. The supporting frame of claim 19 wherein said lever element extends so as to engage between: a rear end (38) of said rigid plate element attached to the bottom of the sole; and the rear portion of the sports shoe which is arranged at a pivoting cuff element (43) of the sports shoe.

* * * * *